US007249729B2

(12) United States Patent
Moritz

(10) Patent No.: US 7,249,729 B2
(45) Date of Patent: Jul. 31, 2007

(54) UTILITY STRAP DISPENSER

(76) Inventor: Joel M. Moritz, 110 N. Boxelder St., Norfolk, NE (US) 68701

( * ) Notice: Subject to any disclaimer, the term of this patent is extended or adjusted under 35 U.S.C. 154(b) by 382 days.

(21) Appl. No.: 11/028,557

(22) Filed: Jan. 5, 2005

(65) Prior Publication Data

US 2006/0163417 A1 Jul. 27, 2006

(51) Int. Cl.
*B65H 16/00* (2006.01)

(52) U.S. Cl. ..... 242/588.6; 242/395; 242/397; 242/615.3; 242/912

(58) Field of Classification Search ..... 242/395, 242/395.1, 397, 405, 588.6, 615.3, 912
See application file for complete search history.

(56) References Cited

U.S. PATENT DOCUMENTS

| | | | | |
|---|---|---|---|---|
| 1,154,212 | A | 9/1915 | Schloss | |
| 2,589,192 | A | 3/1952 | Johnston | |
| 2,706,592 | A | 4/1955 | Schaller | |
| 2,844,334 | A | 7/1958 | Luth | |
| 3,115,243 | A | 12/1963 | Nash | |
| 3,149,719 | A | 9/1964 | Thompson et al. | |
| 3,627,118 | A | 12/1971 | Daggs | |
| 3,810,588 | A | 5/1974 | Mahoney | |
| 3,971,280 | A | 7/1976 | Inka | |
| 4,266,738 | A | 5/1981 | Nakagawa | |
| 4,396,165 | A | 8/1983 | Bates et al. | |
| 5,284,247 | A | 2/1994 | Turner | |
| 5,370,332 | A * | 12/1994 | Goff et al. | 242/344 |
| 5,623,802 | A | 4/1997 | Boushek et al. | |
| 6,561,452 | B2 | 5/2003 | Adams | |
| 6,712,310 | B2 | 3/2004 | Adams | |
| 2002/0166919 | A1 | 11/2002 | Adams | |
| 2002/0179174 | A1 | 12/2002 | Marsche | |
| 2003/0132338 | A1 | 7/2003 | Adams | |

FOREIGN PATENT DOCUMENTS

| | | |
|---|---|---|
| EP | 1260441 | 12/2002 |

* cited by examiner

*Primary Examiner*—John Q. Nguyen
(74) *Attorney, Agent, or Firm*—Richard C. Litman

(57) ABSTRACT

The utility strap dispenser is a container having a top plate and a bottom plate with central mounting apertures. A cylindrical wall having a dispensing slot is provided on an upper surface of the bottom plate defining a chamber for receiving a coil of strap material and a peripheral flange upon the bottom plate. The legs of a metal split pin pass through the central mounting apertures straddling an inner end of a coil of strap material and the free ends of the legs are bent back against the top surface of the top plate securing the container plates together and mounting the coil of strap material for rotation within the container. A guide stop having a guide slot for the passage of the free end of the strap material is provided on the outer surface of the cylindrical wall a predetermined distance from the dispensing slot.

10 Claims, 6 Drawing Sheets

UTILITY STRAP DISPENSER

BACKGROUND OF THE INVENTION

The present invention relates to containers for storing and dispensing coiled flat strap materials such as strips, tapes, webs and the like. More particularly, the present invention relates to a container for storing and dispensing selective lengths of coiled utility strap material that can be suspended or carried by the free end of the strap material.

SUMMARY OF THE INVENTION

The utility strap dispenser according to the present invention is a container preferably for storing and dispensing selective lengths of coiled utility strap material. The container is formed with a round top plate having a central mounting aperture and a round bottom plate provided with a central mounting aperture. A concentrically arranged cylindrical wall is either formed on or secured onto an upper surface of the bottom plate with an outer surface of the wall positioned adjacent the peripheral edge of the bottom plate defining a coil-receiving chamber and a peripheral flange on the bottom plate. The top plate rests upon a top edge of the cylindrical wall and closes the coil-receiving chamber of the container.

The legs of a metal split pin are passed through the central mounting apertures in the top and bottom plates so as to straddle an inner end of the coiled material. The free ends of the legs are bent back against the top surface of the top plate to secure the container plates together and mount the coil of strap material for rotation within the chamber of the container. A slot is provided through the cylindrical wall for dispensing the strap material from the container.

A curved guide stop is either formed on or mounted onto the outer surface of the cylindrical wall spaced a predetermined distance from the dispensing slot. The curved guide stop includes an upper end having a guide slot for the passage of the free end of the strap material and a lower end secured to the outer surface of the cylindrical wall.

When the free end of strap material is held and the container let fall free under the force of gravity, the strap material frictionally binds itself in the guide slot of the guide stop so that the container may be suspended by the free end of the strap material for convenient use, storage or transport of the container without releasing unwanted lengths of strap material from the coil within the container.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
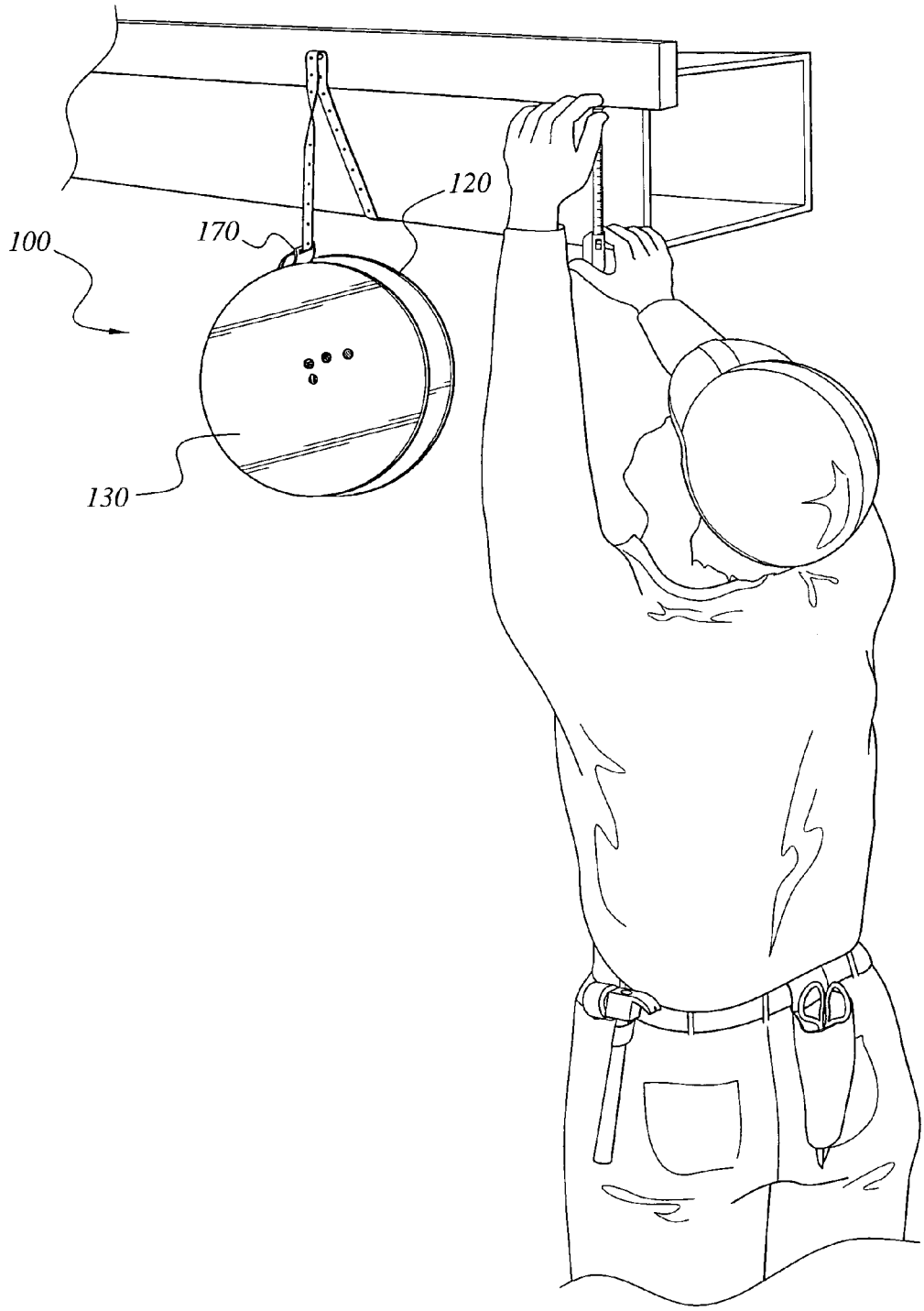
FIG. 1 is an environmental, perspective view of a utility strap dispenser according to the present invention.
Figure 2:
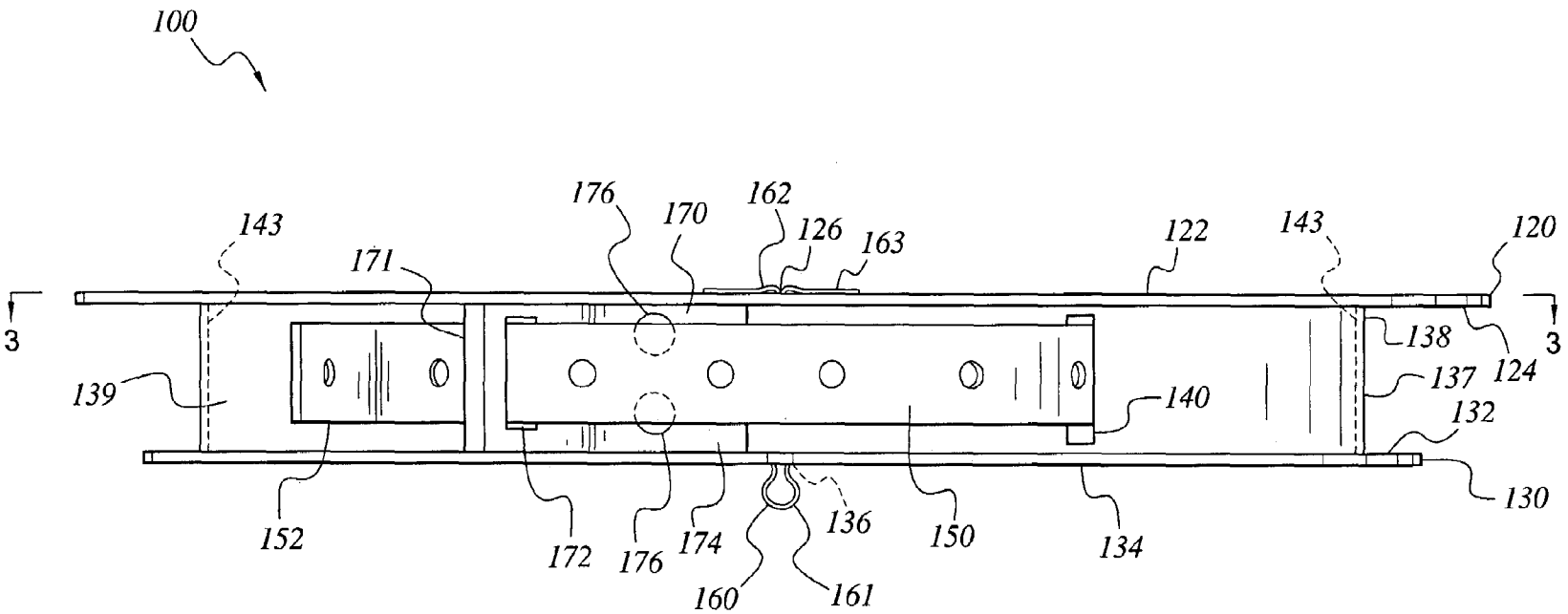
FIG. 2 is a side view of the utility strap dispenser according to the present invention.
Figure 3:
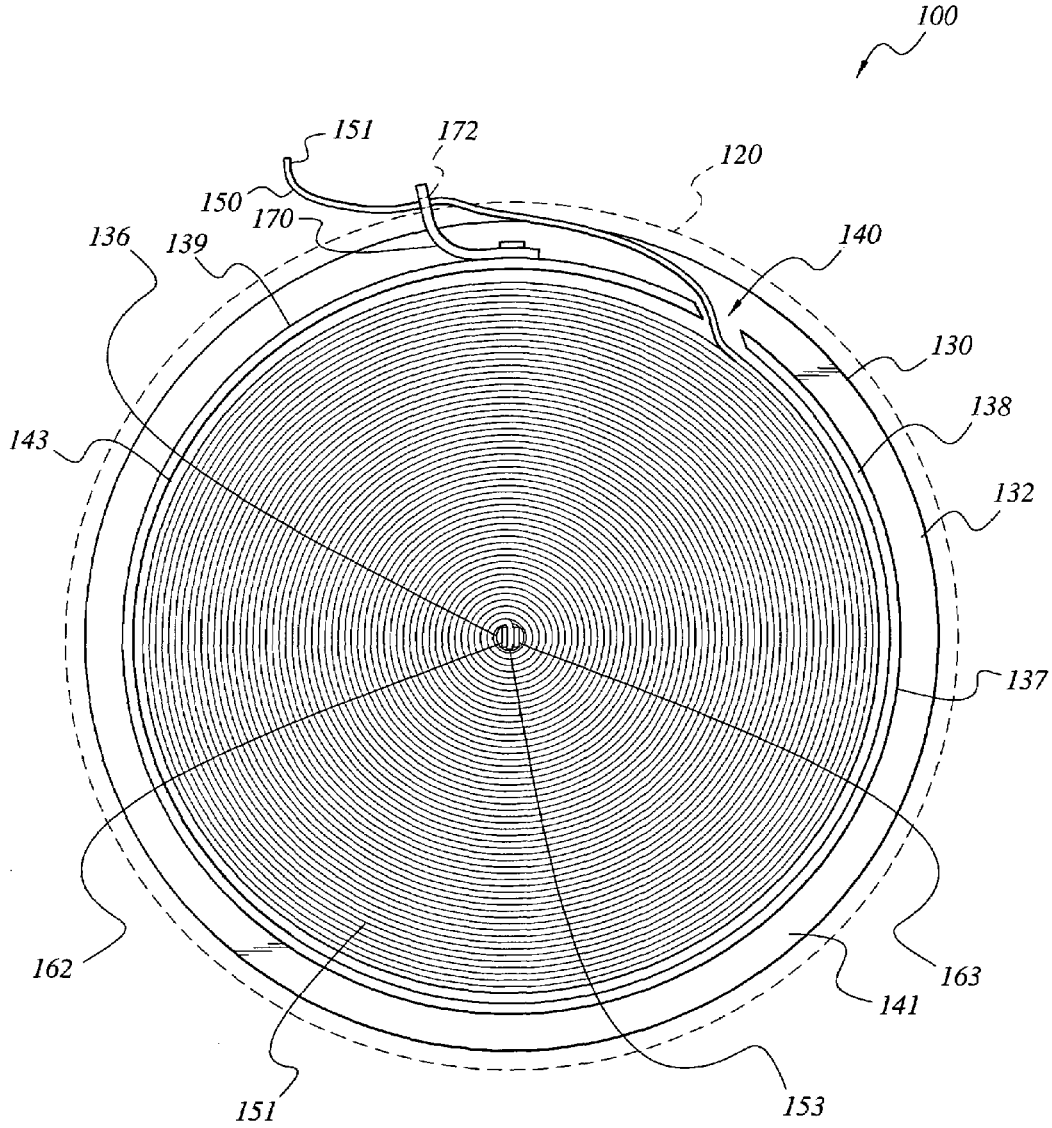
FIG. 3 is a top sectional view of the utility strap dispenser according to the present invention drawn along lines 3-3 of FIG. 2.
Figure 4:
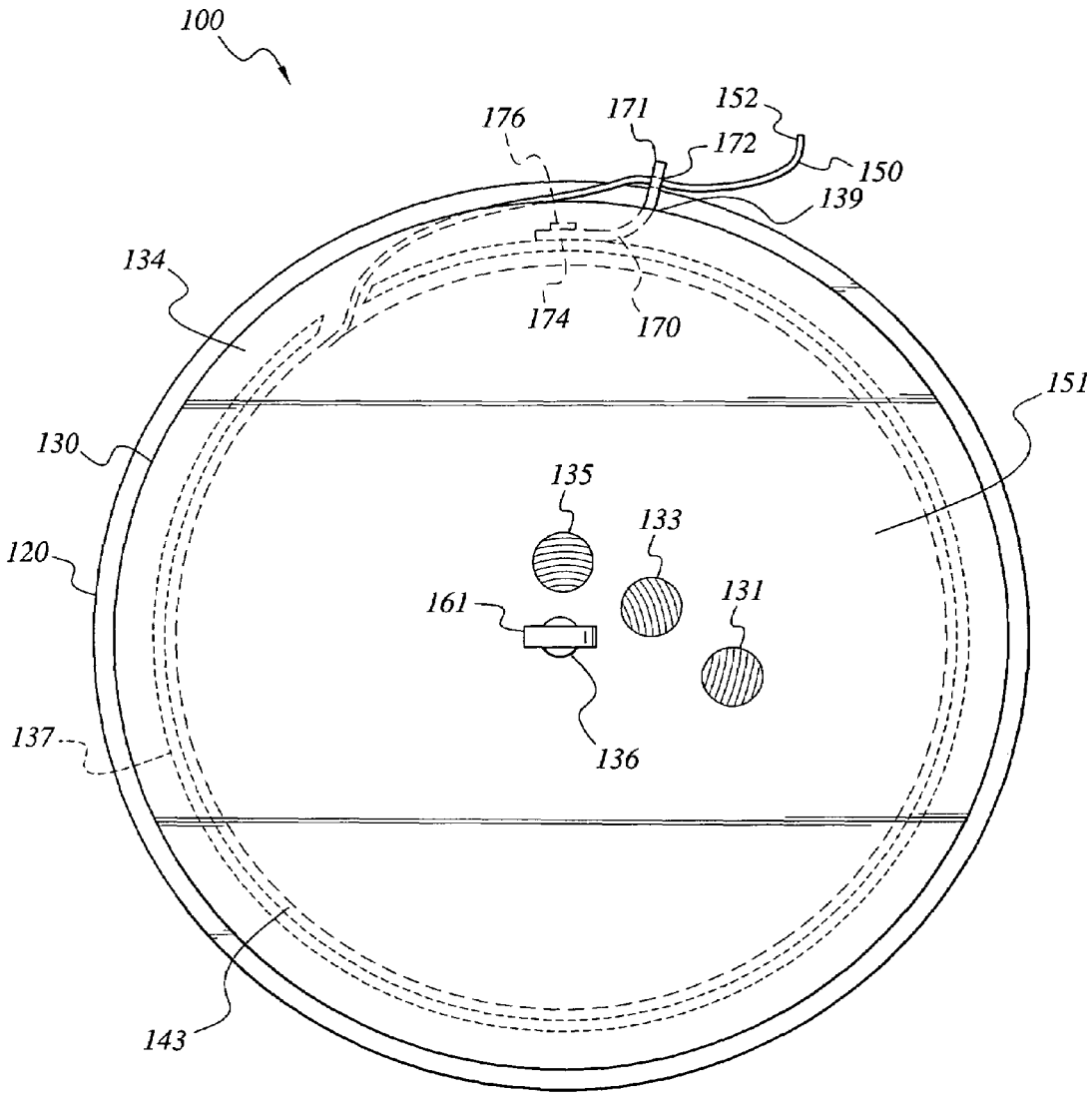
FIG. 4 is a bottom view of the utility strap dispenser according to the present invention.
Figure 5:
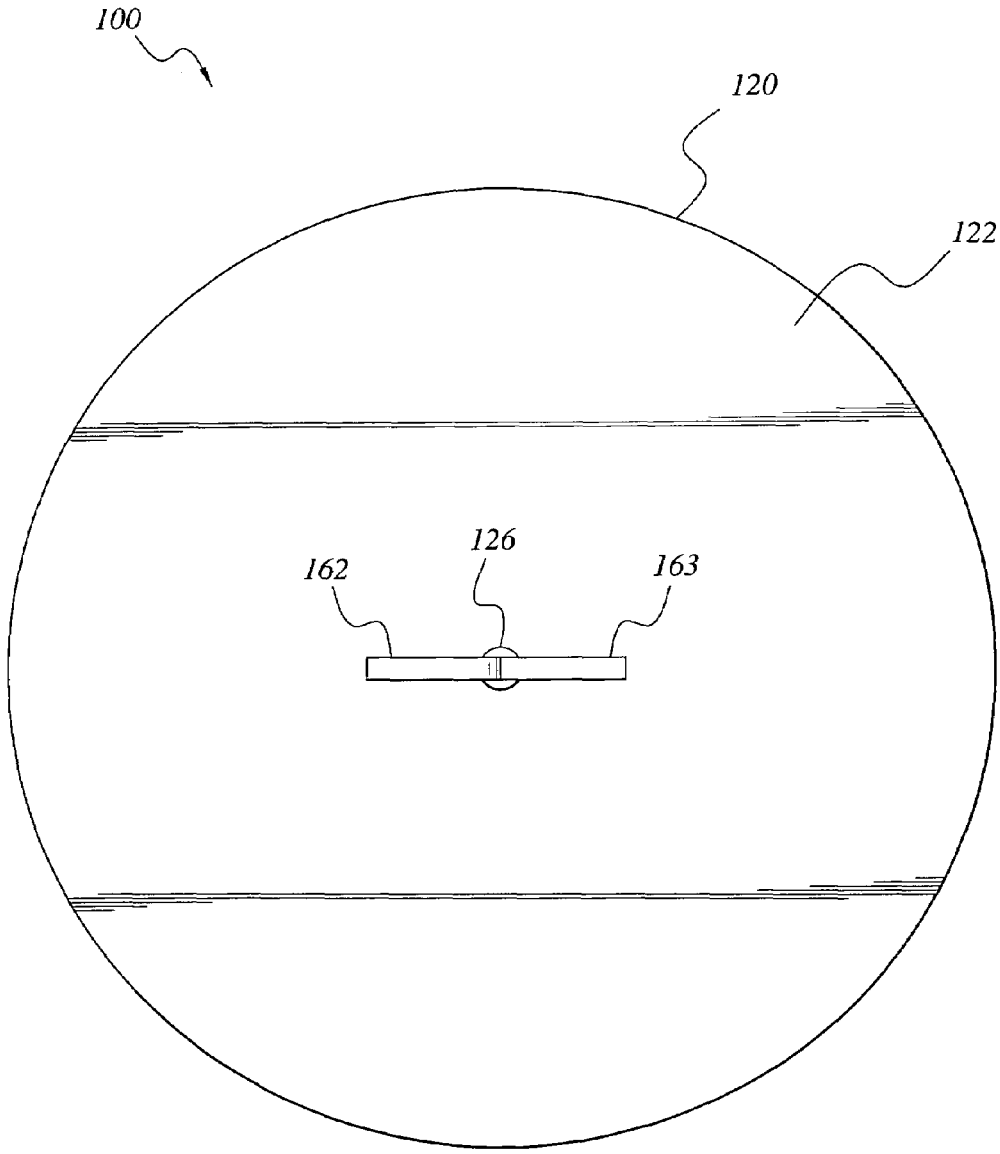
FIG. 5 is a top view of the utility strap dispenser according to the present invention.

The present invention is a container 100 for, preferably storing and dispensing selective lengths of strap material formed into a coil 151. See FIGS. 2-5. Coiled strap materials suitable for dispensing from container 100 are commercially available in a variety of sizes that are used, for example, in the HVAC (Heating Ventilation and Air Conditioning) and plumbing industries, such as, the metal or plastic hanger straps, pipe and webbing straps of the BRAMEC company U.S.A. Container 100 may also suitably dispense commercially available foam insulating window strips.

The container 100 is formed with a round top plate 120 having a central mounting aperture 126 and a round bottom plate 130 provided with a central mounting aperture 136. A concentrically arranged cylindrical wall 137 is either formed on or secured onto an upper surface 132 of the bottom plate 130 adjacent the peripheral edge of the bottom plate 130 defining a coil-receiving chamber 143 for receiving a coil of strap material 151 and a peripheral flange 141 on the bottom plate 130. The top plate 120 rests upon a top edge 138 of the cylindrical wall 137 closing the coil-receiving chamber 143 of the container 100.

A metal split pin 160 includes an enlarged head 161, a first leg 162 and a second leg 163. The head 161 is larger than mounting aperture 136 in bottom plate 130. Legs 162, 163 of a split pin 160 are passed through the central mounting aperture 136 in bottom plate 130 so as to straddle an inner end 153 of the coil 151 of strap material. The free ends of the first leg 162 and second leg 163 are passed through the central mounting aperture 126 of top plate 120 and bent back against the top surface 122 of the top plate 120 to secure top plate 120 and bottom plate 130 of container 100 together and mount the coil 151 of strap material for rotation within the coil-receiving chamber 143 of the container 100. A slot 140 is provided through the cylindrical wall 137 for dispensing the strap material 150 from the container 100.

A curved guide stop 170 is either formed on or mounted onto the outer surface 139 of the cylindrical wall 137 at a predetermined distance from the dispensing slot 140. The curved guide stop 170 includes an upper end 171 having a guide slot 172 for the passage of the free end 152 of the strap material 150 and a lower end 174 secured to the outer surface 139 of the cylindrical wall 137.

When the free end 152 of strap material 150 is held and the container 100 let fall free under the force of gravity, the strap material 150 frictionally binds itself in the guide slot 172 of the guide stop 170 so that the container 100 may be suspended by the free end 152 of the strap material without releasing any of the remaining from the coil 151 within container 100. FIG. 1 shows a strap material 150 being used as a temporary support. The free end 152 of strap material 150 is anchored to one side of an object and the strap material 150 looped under the object and anchored. As shown in FIG. 1, the container 100 can be released to free ones hands for other uses. After the temporary use, the dispensed amount of strap material 150 can be rewound into container 100 using the bent portions of legs 162 and 163 of split pin 160 preventing waste.

The container 100 can be fabricated from 21-28 gauge light sheet metal or injection-molded using a suitable sturdy plastic material. When container 100 is formed from sheet metal, the curved plastic guide stop 170 is secured to the container wall 137 with suitable fastener elements, such as rivets 176, best seen in FIG. 4.

Figure 6:
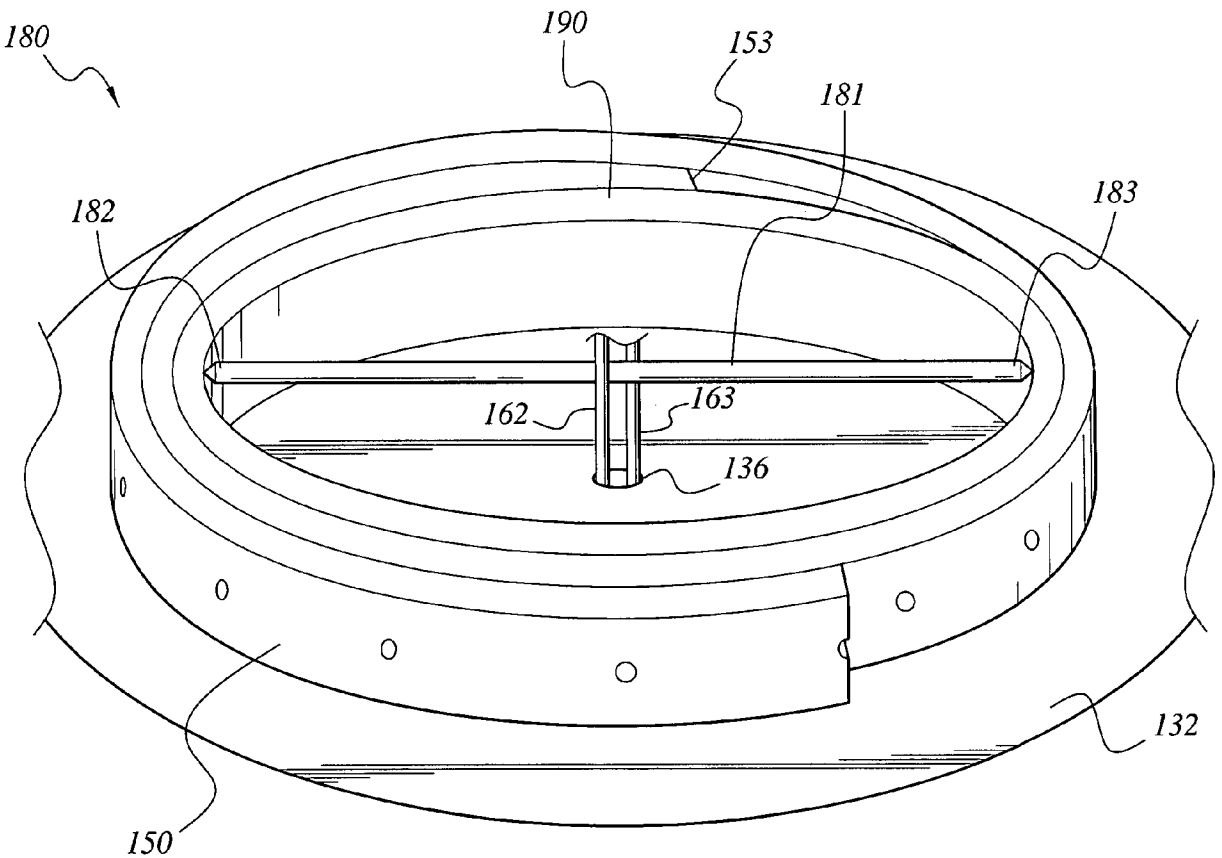
FIG. 6 is a perspective view the spin pin according to the present invention engaging an inner wall of coil mounting ring.

Turning now to FIG. 6, to enable the use of coils of strap material wound upon a cardboard ring 190 and the like, a spin pin 180 is provided. Spin pin 180 is preferably provided in the form of an elongated rod 181 having a first sharpened end 182 and a second sharpened end 183. The length of the spin pin 180 is selected to be slightly greater than the inner diameter of the particular ring 190 the strap material 150 is wound upon so that the sharpened ends penetrate the inner surface of ring 190. First leg 162 and second leg 163 of split pin 160 straddle the spin pin 180 in the coil-receiving chamber 143 to impart rotational movement to the coil 151.

In order to keep track of the supply of strap material 150 within container 100, the bottom plate 130 is also provided with depletion indicating openings 131, 133 and 135 arranged about the central aperture 136. Indicating openings 131, 133 and 135, respectively provide sequential indications of the amount of strap material 150 remaining in the container 100.

It is to be understood that the present invention is not limited to the embodiments described above, but encompasses any and all embodiments within the scope of the following claims.

I claim:

1. A utility strap dispenser for storing and dispensing strap material formed in a coil, comprising:

a round top plate having a top surface, a bottom surface, and a central aperture;

a round bottom plate having an upper surface, a bottom surface and a central aperture;

said bottom plate further including a cylindrical wall concentrically arranged around said central aperture upon said upper surface of said bottom plate defining a coil receiving chamber and a peripheral flange on said bottom plate;

said wall having an outer surface and a dispensing slot for the passage of strap material there through;

a curved guide stop having an upper end and a lower end, wherein said upper end includes a guide slot for the passage of strap material there through, and said lower end is affixed onto said outer surface of said wall at a predetermined distance from said dispensing slot; and a metal split pin having a head larger than said central apertures with a first leg and a second leg attached to said head, wherein the free ends of said legs of said split pin are passed through said central apertures of said top and said bottom plate so as to straddle an inner end of a coil of strap material and thereafter bent back upon said top surface of said top plate to secure said plates together.

2. The utility strap dispenser according to claim 1, further comprising:

a spin pin having an elongated rod having a first sharpened end and a second sharpened end for cooperation with said split pin to secure coils of strap material wound upon a ring for rotation within said coil receiving chamber.

3. The utility strap dispenser according to claim 1, further comprising:

at least three depletion indicating openings arranged about said central aperture of said bottom plate for providing sequential indications of the amount of strap material remaining in said dispenser.

4. The utility strap dispenser according to claim 1, wherein said top plate and said bottom plate are formed of sheet metal and said guide stop is formed of a plastic material, said guide stop being affixed to said wall by fasteners.

5. The utility strap dispenser according to claim 4, wherein said fasteners are rivets.

6. The utility strap dispenser according to claim 5, further comprising:

at least three depletion indicating openings arranged about said central aperture of said bottom plate for providing sequential indications of the amount of strap material remaining in said dispenser.

7. The utility strap dispenser according to claim 6, further comprising:

a spin pin having an elongated rod having a first sharpened end and a second sharpened end for cooperation with said split pin to secure coils of strap material wound upon a ring for rotation within said coil receiving chamber.

8. The utility strap dispenser according to claim 1, wherein said top plate, said bottom plate and said guide stop are formed by injection molding of a sturdy plastic material.

9. The utility strap dispenser according to claim 8, further comprising:

at least three depletion indicating openings arranged about said central aperture of said bottom plate for providing sequential indications of the amount of strap material remaining in said dispenser.

10. The utility strap dispenser according to claim 9, further comprising:

a spin pin having an elongated rod having a first sharpened end and a second sharpened end for cooperation with said split pin to secure coils of strap material wound upon a ring for rotation within said coil receiving chamber.

* * * * *